US006736064B2

(12) United States Patent
Simeth

(10) Patent No.: US 6,736,064 B2
(45) Date of Patent: May 18, 2004

(54) DISTRIBUTION DRIVE FOR A ROLL IN A PROCESSING MACHINE SUCH AS A PRINTING PRESS

(75) Inventor: Claus Simeth, Offenbach (DE)

(73) Assignee: MAN Roland Druckmaschinen AG, Offenbach/Main (DE)

( * ) Notice: Subject to any disclaimer, the term of this patent is extended or adjusted under 35 U.S.C. 154(b) by 0 days.

(21) Appl. No.: 10/429,553

(22) Filed: May 5, 2003

(65) Prior Publication Data

US 2004/0000242 A1 Jan. 1, 2004

(30) Foreign Application Priority Data

May 7, 2002 (DE) ..... 202 07 179 U

(51) Int. Cl.[7] ..... B41F 31/00

(52) U.S. Cl. ..... 101/352.03; 101/349; 101/352.06; 101/146; 101/147

(58) Field of Search ..... 101/146, 147, 101/350.3, 352.06, 349

(56) References Cited

U.S. PATENT DOCUMENTS 4,040,347 A 8/1977 Johne et al.
4,170,176 A * 10/1979 Domeniconi ..... 101/330
4,397,236 A * 8/1983 Greiner et al. ..... 101/350.3
5,619,922 A 4/1997 Kelm
6,397,744 B1 * 6/2002 Jentzsch et al. ..... 101/352.06
6,546,865 B2 * 4/2003 Fischer et al. ..... 101/350.3

FOREIGN PATENT DOCUMENTS

DE 26 21 429 A1 2/1977
DE 32 05 391 A1 11/1982
DE 42 04 604 C2 8/1994
DE 44 42 302 A1 5/1996
GB 2 097 505 A 11/1982

* cited by examiner

*Primary Examiner*—Andrew H. Hirshfeld
*Assistant Examiner*—Marissa Ferguson
(74) *Attorney, Agent, or Firm*—Leydig, Voit & Mayer, Ltd.

(57) ABSTRACT

A distribution drive for a roll in a processing machine, and particularly in a press which has an improved axial motion distribution mechanism and which requires little installation space. This is achieved by an input drive mechanism coupled to a drive having at least one pinion gear 8 which is coupled to a gear 10. Arranged on a side face of the gear 10 is a first pin 17 which, together with a second pin 22, forms a rotary joint 20 by the first pin 17 penetrating the second pin 22. Together with a bearing arm 23, the second pin 22 forms a sliding joint 21, with the second pin 22 being accommodated at the ends in the bearing arm 23, and the bearing arm 23 being coupled to the roll 3.

7 Claims, 6 Drawing Sheets

DISTRIBUTION DRIVE FOR A ROLL IN A PROCESSING MACHINE SUCH AS A PRINTING PRESS

FIELD OF THE INVENTION

The present invention relates generally to a distribution drive for a rotatable oscillating roll in a processing machine, and more particularly, to a distribution drive for a distributor roll in a printing press.

BACKGROUND OF THE INVENTION

A distribution drive of the foregoing type is disclosed in DE 26 21 429 A1. The distribution drive is used for axially oscillating a roll which can be rotatably driven, sometimes referred to as a distributor roll. The roll preferably is a constituent part of an inking unit, which is formed by a plurality of rolls, including a plurality of distributor rolls. Each distributor roll has its own drive for the axial distribution movement (also referred to as oscillatory movement), and this distribution movement is adjustable in terms of its phase angle. The distribution mechanism comprises an axially rigid bush which is provided with a cam groove and which is enclosed by a sliding-block cup. At the sliding-block cup there is arranged a sliding block which engages the cam groove in the bush and is connected to the distributor roll via a double lever. The sliding-block cup is arranged such that it can be adjusted in the circumferential direction and be moved axially.

The disadvantage of such drive is that the distribution mechanism is relatively complicated in design, as a result of the components used, such as the bush with cam groove, sliding-block cup, and the double lever. Because installation space in a printing press often is limited, such drive can only be used to a limited extent in printing machines.

OBJECTS AND SUMMARY OF THE INVENTION

It is an object of the present invention to provide a distribution drive for a roll, such as a distributor roll in a printing press, which is simple in design and which requires relatively small installation space.

The distribution drive of the present invention has significant advantages over the prior art. First and foremost, it has a compact overall design and can be installed in much smaller space in the machine than heretofore possible. Furthermore, the distribution drive can be implemented with relative few parts which can be produced cost-effectively.

A further advantage of the distribution drive of the invention is that is can be universally used in processing machines, and particularly for driving distributor rolls of inking and/or damping units of offset printing presses.

It also is advantageous that the drive for rotational movement of the distributor roll may be arranged at one end of the distributor roll, and the drive for the distribution movement may be arranged at the opposite end of the distributor roll. Dividing up the drives to both sides for the rotational movement and for the distribution movement of the distributor roll necessitates relatively little space on both sides. The axial distribution and/or the oscillatory stroke furthermore, may be adjustable. In that case, it is not necessary to interrupt the drive for the rotational movement of the distributor roll. If required, the rotational drive can be interrupted or connected up again by means of a switching clutch that can be selectively actuated.

It also is advantageous that the axial distribution stroke of the distributor roll can be set permanently on the gear of an input guide mechanism, or can be set in steps, or can be selectively moved in a continuous adjustable manner. To this end, the gear has a pin which can be permanently mounted, or which can be adjusted in steps or which is disposed for continuous sliding movement. The pin is arranged parallel to the axis of a drivable gear, or alternatively, can be mounted coaxial with the gear if the distribution stroke of the distribution roll is to be zero.

A further advantage is that if a plurality of distributor rolls are arranged, for example in an inking unit of an offset press, the drives for the rotational movement of the rolls may be arranged on one side of the processing machine, and the drives for distribution movement of the rolls may be arranged on the opposite side. All the drives for the rotational movement in that case may be coupled to one another. Likewise, the drives for the distribution movement may be coupled to one another.

In the event that a plurality of distributor rolls are arranged, for example in an inking unit, the associated distribution drives preferably are of identical design. A flexible drive mechanism preferably can be arranged on a drive side of the distributor rolls, with a drive pulley provided for each distributor roll. Alternatively, a separate drive for the rotational movement and/or a separate distribution drive can be provided for each distributor roll. For example, centrally or separately controllable individual drives for each distributor roll alternatively can be used.

Other objects and advantages of the invention will become apparent upon reading the following detailed description and upon reference to the drawings, in which:

Figure 1:
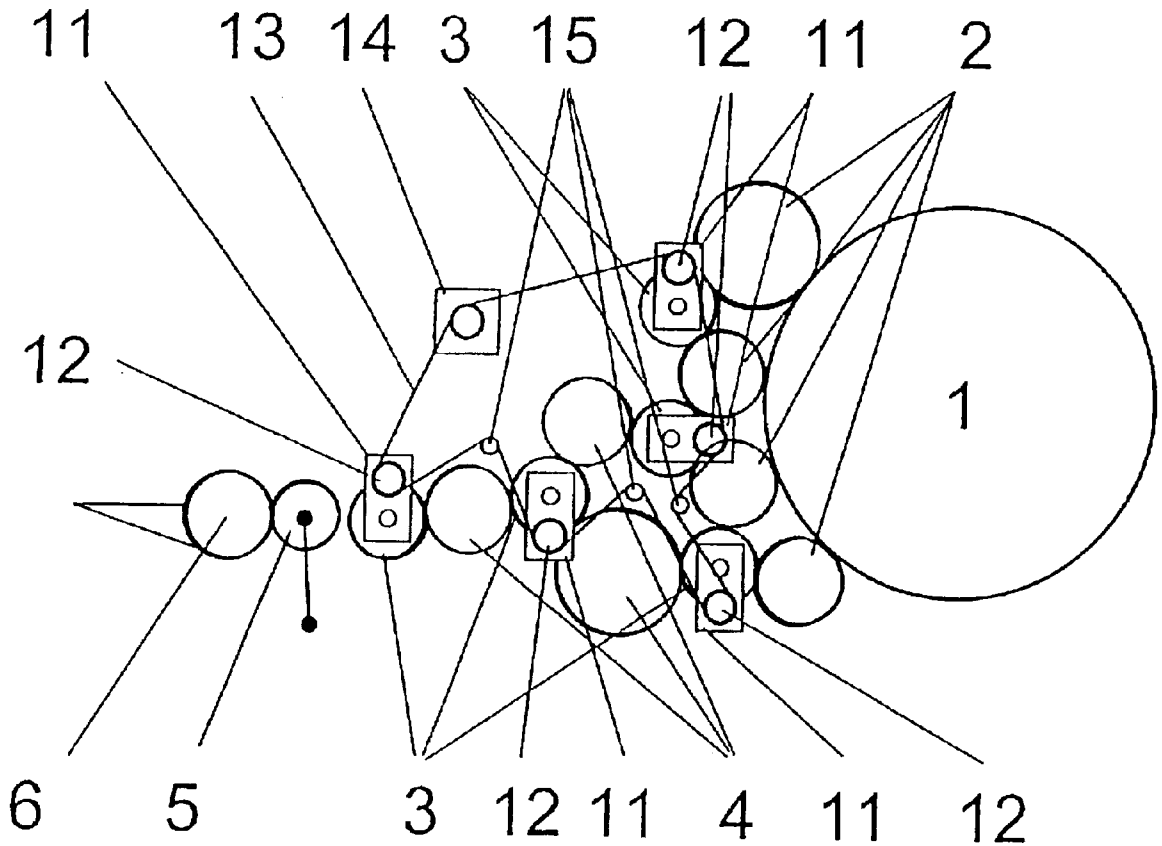
FIG. 1 is a diagrammatic side elevational view of a printing machine inking unit having a plurality of distributor rolls having drive mechanisms in accordance with the present invention.
Figure 2:
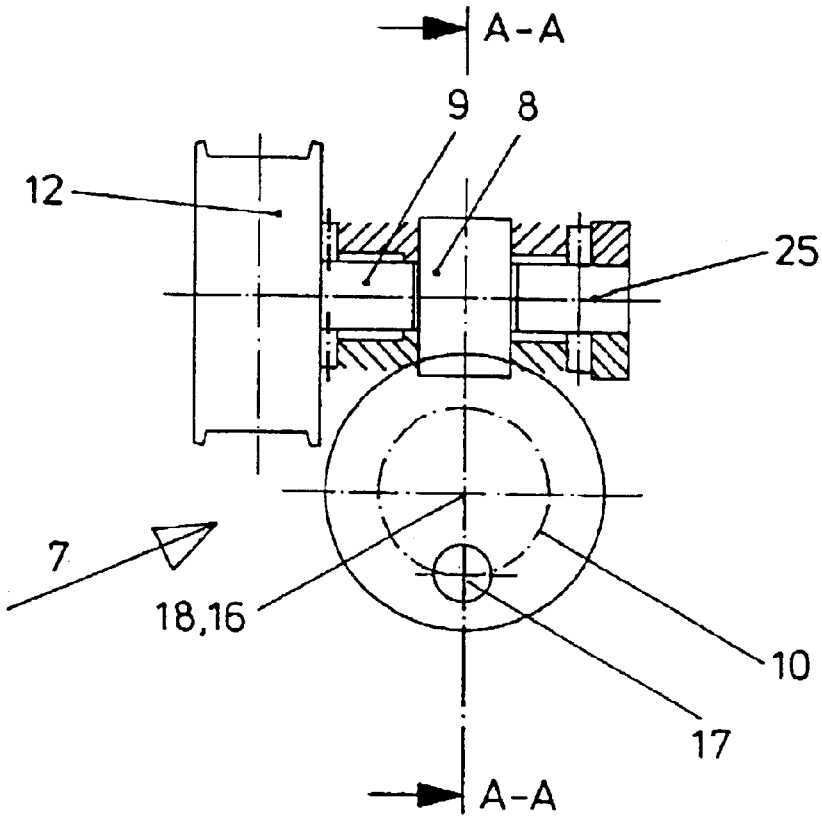
FIG. 2 is an enlarged diagrammatic view of an input drive mechanism for one of the distributor rolls of the inking unit shown in FIG. 1.

While the invention is susceptible of various modifications and alternative constructions, certain illustrated embodiments thereof have been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the invention.

DETAILED DESCRIPTION OF PREFERRED EMBODIMENTS

Referring now more particularly to FIG. 1 of the drawings, there is shown a processing machine in the form of an offset printing press which has a plate cylinder 1 having an associated inking unit. The plate cylinder 1 has an appropriate printing forme, which may be a printing plate ready to print fixed to the plate cylinder or a printing forme which is fixed to the plate cylinder and can be exposed directly. Alternatively, the plate cylinder may be provided without a printing forme or plate cylinder in such way that an image can be set thereon, removed, and renewed directly on the plate cylinder.

The inking unit associated with the plate cylinder 1 in this case includes a plurality of ink applicator rolls 2 disposed in contacting relation to the plate cylinder 1 at circumferentially spaced locations and a plurality of distributor rolls 3 disposed between pairs of the applicator rolls 2 in contacting relation thereto. The distributor rolls 3 each in turn is coupled, directly or indirectly, to inking rolls 4 to establish a closed inking unit roll train. At least one of the distributor rolls 3 is functionally connected to a metering system which, in the present example, is formed by a ductor roll 5 and an ink fountain roll 6 with associated ink fountain. As is known in the art, the ductor roll 5 picks up ink from the ink fountain roll 6 and transfers ink to the roll train so that the printing plate on the forme cylinder 1 cylinders 1 is inked. Alternatively, the metering system can use a film roll of a known type.

For axially oscillating the distributor rolls 3, individual distributor drives 11 are provided for each distributor roll at one end thereof. The distributor drives 11 preferably are identical in construction and operation and are arranged on the same side of the offset press, for example, on the operator side. Each distributor drive 11 in this case has a respective input drive mechanism 7 coupled thereto.

Each input drive mechanism 7 has a belt pulley 12, with each belt pulley 12 being coupled to at least one endlessly circulating flexible drive means 13, for example, a toothed bolt. In this case, the flexible drive means 13 is trained over rotatably mounted deflection rollers 15 fixed to the frame and at least one deflection roller 15 preferably is a tensioning roller for the flexible drive means 13. For driving the flexible drive means 13, the flexible drive means is coupled to a drive motor 14 which preferably is connected by circuitry to an appropriate controller for the machine. The drive motor 14 has a pulley which is coupled in driving engagement with the flexible drive means.

Each input drive mechanism 7 preferably is formed by the belt pulley 12 and an associated pinion gear 8 mounted on a common shaft 9 rotatably supported in the machine frame for rotation about an axis 25 of the pinion gear 8. The pinion gear 8 in turn engages a gear 10 arranged on a gear shaft 18 having a rotary axis 16.

In a preferred embodiment, the pinion gear 8 and the gear 10 are constructed as a conventional worm gear mechanism. The pinion gear 8 preferably is the worm and the gear 10 is the worm wheel. The pinion axis 25 and the gear axis 16 are arranged in 90° offset relation to each other in planes that are spaced apart. It will be apparent that a worm gear mechanism of such type can operate with little noise and can be arranged in a space-saving manner within the processing machine.

Each distribution drive 11 is arranged downstream of a respective input drive mechanism 7 comprising the belt pulley 12, pinion gear 8, and gear 10. For this purpose, a first pin 17 is mounted at one axial side face of the gear 10, preferably being in offset parallel relation to the gear axis 16. Hence, this first pin 17 preferably is arranged eccentrically with respect to the gear axis 16. As will be understood, the size of the offset of the first pin 17 in relation to the gear axis 16 corresponds to the desired axial distribution stroke of the distributor roll 3.

The first pin 17 may be captively mounted on a side face of the gear 10, or preferably, releasably and selectively positionably mounted on the axial side face, such as by mounting in a radial slot or in any of a plurality of radially spaced plug-in holes adapted for receiving the pin 17. The pin 17 can either be positioned in a selected hole for effecting the desired oscillating stroke of the distributor roll, or alternatively, can be slid along the slot for infinite adjustment in the stroke depending upon the location of the pin in the slot. Alternatively, mounting the pin in a position coaxial with the gear axis 16 will result in an axial distribution stroke of zero such that the distribution roll is then only rotatably driven.

Figure 3:
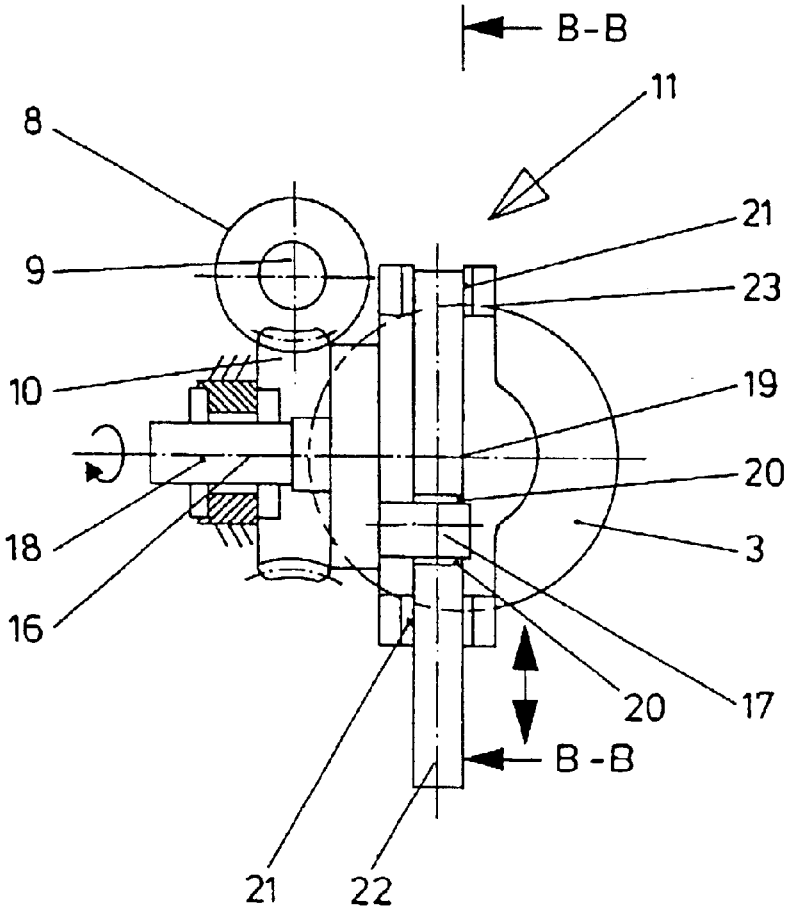
FIG. 3 is a vertical section of the input drive mechanism, taken in the plane of line A—A in FIG. 2.
Figure 4:
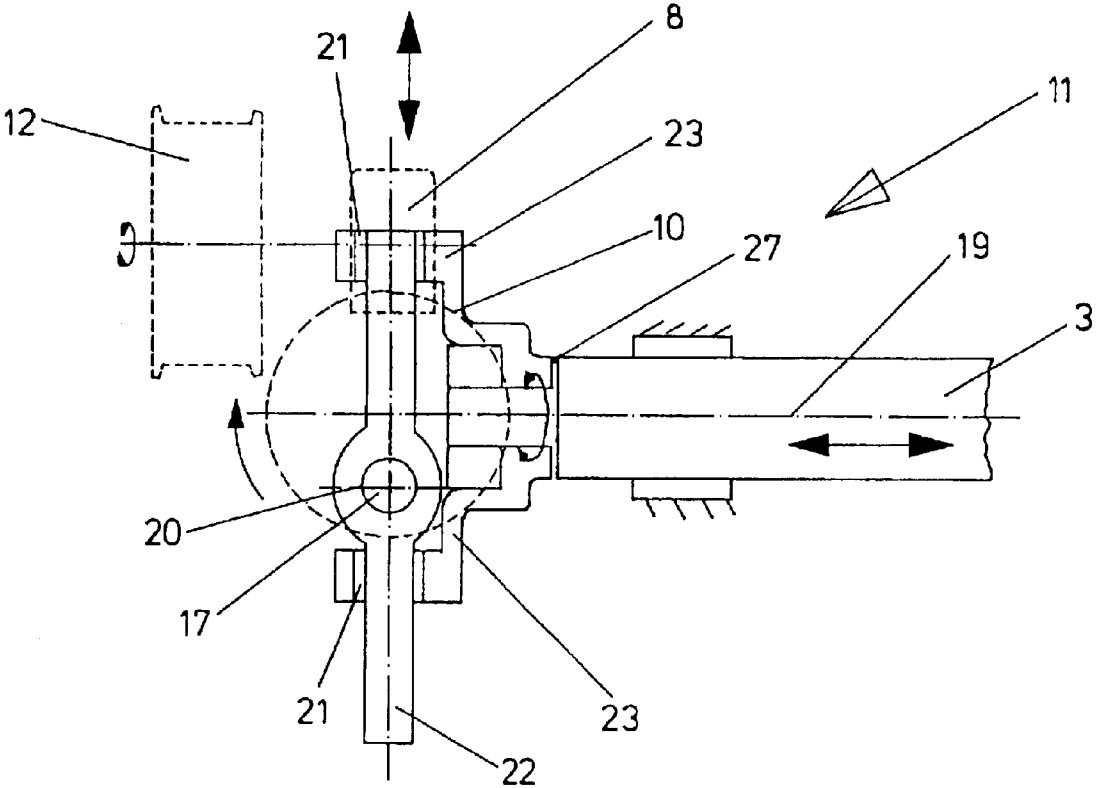
FIG. 4 is a section of the input drive mechanism taken in the plane of line B—B in FIG. 3.

In the illustrated embodiment, the first pin 17 penetrates and is received in a second pin 22 with their axes crossing at right angles, as depicted in FIG. 3. The first pin 17 in this case forms a rotary joint 20 with the second pin 22. The second pin 22 is mounted at the end in a bearing arm 23 such that it can slide axially in two sliding joints 21 at opposite ends of the bearing arm. Hence, there is established a rotary/sliding joint 20/21. To this end, one side of the bearing arm 23 supports the second pin 22 at its opposite sides, and the other end of the bearing arm 23 is coupled to the distributor roll 3 by way of a further rotary joint 27 such that it can rotate about the distributor roll axis 19.

In summary, the distribution drive 11, according to this embodiment, comprises at least the input drive mechanism 7 coupled to a drive and having at least one pinion gear 8 coupled to the gear 10. Arranged on a side face of the gear 10 is the first pin 17, which forms the rotary joint 20 with the second pin 22, with the first pin 17 penetrating the second pin 22. With the bearing arm 23, the second pin 22 forms the sliding joints at both ends in the bearing arm 23. At the opposite end, the bearing arm 23 is coupled to the roll 3, such that it can move in rotation about the distributor roll axis 19, forming a further rotary joint 27.

The mode of operation is as follows: From the belt driven pulley 12 the pinion gear 8 is driven via the shaft journal 9, which in turn drives the gear 10. The gear 10 rotates about the gear axis 16 and the first pin 17 rotates centrally, if it is arranged on the gear axis 16, or eccentrically, if positioned on the side face of the gear 10 in eccentric relation to the gear axis 16. During the rotational movement of the gear 10, the first pin 17 rotates in the rotary joint 20 and the second pin 22 moves axially in the sliding joints 21. At the same time, the bearing arm 23 is moved to and fro axially in the direction of the distributor roll axis 19 by the pins 17, 22, and thus the distributor roll 3 is set into an axial distribution movement along the distributor roll axis 19 depending on the setting of the pin 17.

Figure 5:
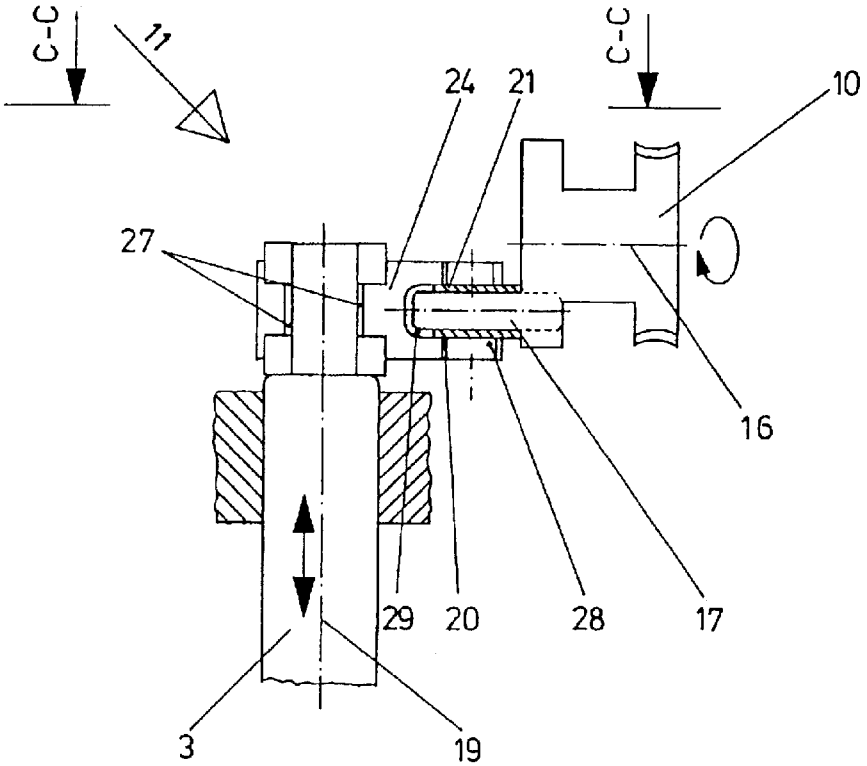
FIG. 5 is a diagrammatic depiction of an alternative embodiment of distributor drive in accordance with the invention.
Figure 6:
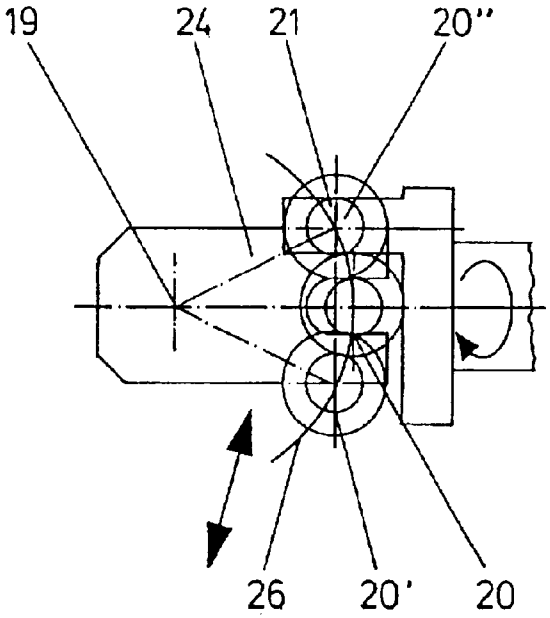
FIG. 6 is a side view of the drive shown in FIG. 5 taken in the plane of line C—C.

In an alternative embodiment, as depicted in FIGS. 5 and 6, the input drive mechanism 7, namely the belt pulley 12, pinion gear 8 and gear 10, are similar to that described above. The first pin 17 is likewise arranged on the gear 10, but, in this case, penetrates an axially fixed hinge pin 27 which is mounted such that it can rotate in a swinging arm 24. The hinge pin 28 in this case is mounted in the swinging arm 24 in a rotary joint 20. The swinging arm 24 has a recess 29, which serves as a clearance for the sliding movement of the first pin 17, which projects into the recess 29. Hence, the first pin 17 and the hinge pin 28 form a sliding joint 21 and, with the swinging arm 24, the hinge pin 28 forms a rotary joint 20. Hence, the mechanisms define a rotary/sliding joint 20/21. The swinging arm 24 is rotatably mounted in the rotary joint 27 at the end on the distributor roll 3 and, with the rotary/sliding joint 20/21, oscillates on a guide curve 26. The end positions of the rotary joints 20 are indicated in FIG. 6 by the positions 20' and 20".

In summary, in the alternative embodiment as depicted in FIGS. 5 and 6, the distribution drive 11 includes the input drive mechanism 7 coupled to the drive and having at least one pinion gear 8 coupled to the gear 10. Arranged on an end face of the gear 10 is the first pin 17 which, with the hinge pin 28, forms a sliding joint 21. In this case, the first pin 17 penetrates the hinge pin 28. The hinge pin 28, together with the swinging arm 24, forms the rotary joint 20 with the hinge pin 28 being rotatably mounted in the swinging arm 24. The end of the swinging arm 24 is coupled to the roll 3 such that it can rotate about the distributor roll axis 19, forming the further rotary joint 27.

The mode of action is as follows: The belt driven pulley 12 drives the pinion gear 8, and in turn the gear 10, which causes the first pin 17 to rotate centrally or eccentrically around the gear axis 16, depending upon its setting. During the rotation of the gear 10 with the first pin 17, this first pin 17 executes a sliding movement in the hinge pin 28 in the axial direction of the pin 17 (by virtue of the sliding joints 21) and at the same time, the hinge pin 28 moves in the swinging arm 24 (by virtue of the rotary joint 20) and the swinging arm 24 oscillates in the rotary joint 27 about the distributor roll axis 19. At the same time, axial distribution movement is transmitted to the distributor roll 3. It will be understood that the distribution drives all can be driven by the engagement between the flexible drive means and each belt pulley 12. Alternatively, instead of the flexible drive means 13, an individual drive can be used for each distributor roll 3.

What is claimed is:

1. A distribution drive for a roll in a processing machine, such as a printing press, comprising a roll (3) mounted for rotational and axial movement, a first drive for imparting rotational movement to said roll, a second drive for axially moving said roll, said second drive including an input drive mechanism (7) coupled to a power drive; said input drive mechanism including at least one pinion gear (8) operatively coupled to a mating gear (10); a first pin (17) positioned on a side face of said mating gear (10); a second pin (22) which receives said first pin (17) and forms a rotary joint (20); a bearing arm (23) which receives said second pin (22) and forms a sliding joint (21) with the second pin (22); and said bearing arm (23) being coupled to said roll (3) to form a further rotary joint (27) such that operation of said input drive mechanism by said power drive rotates said mating gear (10) to cause axial movement of said roll (3) depending upon the position of said first pin (17) on said side face of the mating gear (10).

2. The distribution drive of claim 1 in which said first pin (17) is captively mounted on the side face of said gear (10).

3. The distribution drive of claim 1 in which said first pin is releasably mounted on the side face of said gear (10) and can be adjustably positioned with respect to the rotary axis of the gear (10).

4. The distribution drive of claim 1 in which said first pin is selectively positionable on the side face of said gear (10) and can be positioned coaxially with the axis of said gear (10) to eliminate axial movement of the roll (3) notwithstanding operation of the input drive mechanism (7).

5. The distribution drive of claim 1 in which on said second pin (22) is mounted two sliding joints (21) of the bearing arm (23).

6. A distribution drive for a roll in a processing machine, such as a printing press, comprising a roll (3) mounted for rotational and axial movement, a first drive for imparting rotational movement to said roll, a second drive for axially moving said roll, said second drive including an input drive mechanism (7) coupled to a power drive; said input drive mechanism including at least one pinion gear (8) operatively coupled to a mating gear (10); a first pin (17) positioned on a side face of said mating gear (10); a hinge pin (28) which receives said first pin (17) and forms a sliding joint (21) therewith; a swinging arm (24) which receives said hinge pin (28) and forms a rotary joint (20) therewith for supporting the hinge pin (28) for relative rotatable movement; and said swing arm (24) being coupled to said roll (3) to form a further rotary joint (27) such that operation of said input drive mechanism by said power drive rotates said mating gear (10) to cause axial movement of said roll (3) depending upon the position of said first pin (17) on said side face of the mating gear (10).

7. The distribution drive of claim 6 in which said swinging arm (24) has a recess (29) into which the first pin (17) projects.

* * * * *